US011319939B2

(12) United States Patent
Bhatia et al.

(10) Patent No.: US 11,319,939 B2
(45) **Date of Patent: *May 3, 2022**

(54) PRECISE CONTROL OF SUCTION DAMPING DEVICE IN A VARIABLE DISPLACEMENT COMPRESSOR

(71) Applicant: Hanon Systems, Daejeon (KR)

(72) Inventors: Kanwal Bhatia, Canton, MI (US); Robert C. Trela, Plymouth Township, MI (US); Teodor Urdea, Novi, MI (US)

(73) Assignee: HANON SYSTEMS, Daejeon (KR)

( * ) Notice: Subject to any disclaimer, the term of this patent is extended or adjusted under 35 U.S.C. 154(b) by 191 days.

This patent is subject to a terminal disclaimer.

(21) Appl. No.: 16/833,767

(22) Filed: Mar. 30, 2020

(65) Prior Publication Data

US 2020/0224647 A1 Jul. 16, 2020

Related U.S. Application Data

(62) Division of application No. 15/831,863, filed on Dec. 5, 2017, now Pat. No. 10,655,617.

(51) Int. Cl.
*F04B 7/00* (2006.01)
*F04B 11/00* (2006.01)
(Continued)

(52) U.S. Cl.
CPC ..... *F04B 7/0046* (2013.01); *F04B 7/0076* (2013.01); *F04B 11/00* (2013.01);
(Continued)

(58) Field of Classification Search
CPC .. F04B 7/0046; F04B 7/0283; F04B 39/0027; F04B 39/0038; F04B 49/022;
(Continued)

(56) References Cited

U.S. PATENT DOCUMENTS 5,695,325 A 12/1997 Sperry
6,390,782 B1 5/2002 Booth et al.
(Continued)

FOREIGN PATENT DOCUMENTS

JP 2001521112 A 11/2001
JP 2006291976 A 10/2006
(Continued)

*Primary Examiner* — Kenneth J Hansen
(74) *Attorney, Agent, or Firm* — Shumaker, Loop & Kendrick, LLP; James D. Miller

(57) ABSTRACT

A suction damping device for a variable displacement compressor includes a rotor rotatably received within a stator disposed in a suction port of the variable displacement compressor. The rotor includes an aperture and the stator includes a pair of opposing openings in selective fluid communication with the aperture of the rotor. An electromagnetic device controls a rotational position of the rotor relative to the stator based on a condition of an electrically controlled valve used to control an angle of inclination of a swashplate of the variable displacement compressor. A changing of the rotational position of the rotor relative to the stator causes a variable overlap to be formed between the aperture of the rotor and the openings of the stator to control a flow of a refrigerant through the suction damping device.

9 Claims, 5 Drawing Sheets

(51) Int. Cl.

| | |
|---|---|
| ***F04B 49/12*** | (2006.01) |
| ***F04B 39/00*** | (2006.01) |
| ***F04B 27/10*** | (2006.01) |
| ***F04B 39/08*** | (2006.01) |
| ***F04B 27/18*** | (2006.01) |

(52) U.S. Cl.
CPC ..... *F04B 27/1036* (2013.01); *F04B 39/0038* (2013.01); *F04B 39/0055* (2013.01); *F04B 39/08* (2013.01); *F04B 49/125* (2013.01); *F04B 2027/1813* (2013.01); *F04B 2027/1827* (2013.01); *F04B 2027/1877* (2013.01); *F04B 2027/1881* (2013.01)

(58) Field of Classification Search
CPC ..... F04B 49/03; F04B 49/225; F16K 31/041; F16K 5/0407
See application file for complete search history.

(56) References Cited

U.S. PATENT DOCUMENTS

| | | | | |
|---|---|---|---|---|
| 7,014,428 | B2 * | 3/2006 | Pitla | F04B 27/1804 184/26 |
| 7,959,420 | B1 | 6/2011 | Sperry | |
| 8,277,200 | B2 | 10/2012 | Bona et al. | |
| 8,292,596 | B2 | 10/2012 | Ota et al. | |
| 2002/0139950 | A1 * | 10/2002 | Lanz | F16K 31/041 251/129.11 |
| 2006/0083625 | A1 | 4/2006 | Koyama et al. | |
| 2009/0065724 | A1 * | 3/2009 | Mitton | B01F 5/008 251/209 |
| 2010/0092311 | A1 | 4/2010 | Kim et al. | |

FOREIGN PATENT DOCUMENTS

| | | | | |
|---|---|---|---|---|
| JP | 2011012548 | A | 1/2011 | |
| WO | WO-0019133 | A1 * | 4/2000 | F16K 5/0407 |

* cited by examiner

PRECISE CONTROL OF SUCTION DAMPING DEVICE IN A VARIABLE DISPLACEMENT COMPRESSOR

CROSS-REFERENCE TO RELATED APPLICATION

This patent application is a divisional patent application of U.S. patent application Ser. No. 15/831,863 filed Dec. 5, 2017, the entire disclosure of which is hereby incorporated herein by reference.

FIELD OF THE INVENTION

The present invention relates to a variable displacement compressor for use in an air conditioning system for a vehicle, and more particularly to an electrically controlled suction damping device disposed in a suction port of the variable displacement compressor.

BACKGROUND OF THE INVENTION

As is commonly known, variable displacement compressors having a swashplate are used in air conditioning systems of motor vehicles. Such compressors typically include at least one piston disposed in a cylinder of a cylinder block and a rotor assembly operatively coupled to a drive shaft. The swashplate is coupled to and adapted to be rotated by the rotor assembly during rotation of the drive shaft. The swashplate is variably angled relative to the drive shaft between a minimum angle of inclination and a maximum angle of inclination. Each piston slidably engages with the swashplate through a shoe as the swash plate rotates, thereby causing each piston to reciprocate within the corresponding cylinder of the cylinder block. As the angle of inclination of the swashplate is varied, so too is the displacement of each piston within each cylinder, thereby causing the flow rate of a refrigerant flowing through the compressor to vary. The flow rate varies between a maximum flow rate when the swashplate is positioned at a maximum angle of inclination relative to the drive shaft and a minimum flow rate when the swashplate is positioned at a minimum angle of inclination relative to the drive shaft.

It is not uncommon for variable displacement compressors to develop suction pulsations. The suction pressure pulsations may propagate throughout the air conditioning system. When these pressure pulsations reach certain components of the air conditioning system, such as the evaporator, the pressure pulsations may cause noise to be generated that can be heard in a passenger compartment of the vehicle.

The problem of noise generation caused by suction pulsation has previously been addressed by the addition of a suction damping device within the variable displacement compressor. The suction damping device traditionally includes a spring loaded plunger reciprocatingly disposed within a body having flow openings formed therein. The position of the plunger within the body determines a cross-sectional flow area by which the refrigerant may flow through the suction damping device during different operating modes of the variable displacement compressor.

There are two primary methods for determining the position of the plunger of the suction damping device and therefore the flow rate of the refrigerant through the suction damping device. One method includes the flow of the refrigerant entering the compressor exerting pressure on the plunger to apply a force against the biasing of the spring in contact with the plunger. The depression of the spring and subsequent repositioning of the plunger alters the cross-sectional flow area past the plunger to regulate the flow rate of the refrigerant entering the compressor. One issue present when employing this method is that the plunger typically has to be biased by a relatively stiff spring to properly control the pressure pulsations. The use of a stiff spring negatively affects the efficient operation of the compressor by causing the refrigerant to undergo an undesirably large pressure drop when exerting the pressure force on the plunger to open the suction damping device. The use of a stiff spring may also result in a lower maximum flow capacity of the compressor due to the spring preventing a full opening of the suction damping device under certain operating conditions.

The second known method includes using a known pressure difference between a crankcase chamber having the swash plate disposed therein and a suction chamber disposed downstream of the suction damping device to control a position of the plunger within the body. This approach requires the addition of flow passageways within the variable displacement compressor for communicating the refrigerant at the various different pressure values to the suction damping device in order to control the position of the plunger thereof, thereby increasing the complexity of the variable displacement compressor while also presenting additional fluid passageways in need of suitable sealing means and flow control. Such suction damping devices also utilize a spring for biasing a valve element, which may negatively cause the suction damping device to be subject to the effects of hysteresis of the spring when operating under certain conditions.

It would therefore be desirable to produce a suction damping device that minimizes noise generation in an air conditioning system by providing precise control of a variable flow area of a refrigerant flow as the refrigerant flow enters a suction port of a variable displacement compressor.

SUMMARY OF THE INVENTION

Concordant and congruous with the present invention, a suction damping device utilizing an electromagnetic device to control a variable flow area through the suction damping device has surprisingly been discovered.

According to an embodiment of the invention, a suction damping device for a variable displacement compressor comprises a rotor having a rotational axis. An aperture extends through the rotor in a direction transverse to the rotational axis thereof. The rotor is selectively rotated about the rotational axis thereof to control a flow of a fluid through the aperture of the rotor.

According to another embodiment of the invention, a variable displacement compressor is disclosed. The variable displacement compressor comprises an electrically controlled valve configured to selectively control an angle of inclination of a swashplate of the variable displacement compressor and a suction damping device including a rotor having a rotational axis. An aperture extends through the rotor in a direction transverse to the rotational axis thereof. The rotor is selectively rotated about the rotational axis thereof based on a condition of the electrically controlled valve to control a flow of a fluid through the aperture of the rotor.

According to a further embodiment of the invention, a method of controlling a variable displacement compressor is disclosed. The method comprises the steps of providing a suction damping device including a rotor having a rotational axis, an aperture extending through the rotor in a direction transverse to the rotational axis, and selectively rotating the rotor about the rotational axis thereof based on a condition of an electrically controlled valve of the variable displacement compressor to control a flow of a fluid through the aperture of the rotor.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF EXEMPLARY EMBODIMENTS OF THE INVENTION

The following detailed description and appended drawings describe and illustrate various exemplary embodiments of the invention. The description and drawings serve to enable one skilled in the art to make and use the invention, and are not intended to limit the scope of the invention in any manner.

Figure 1:
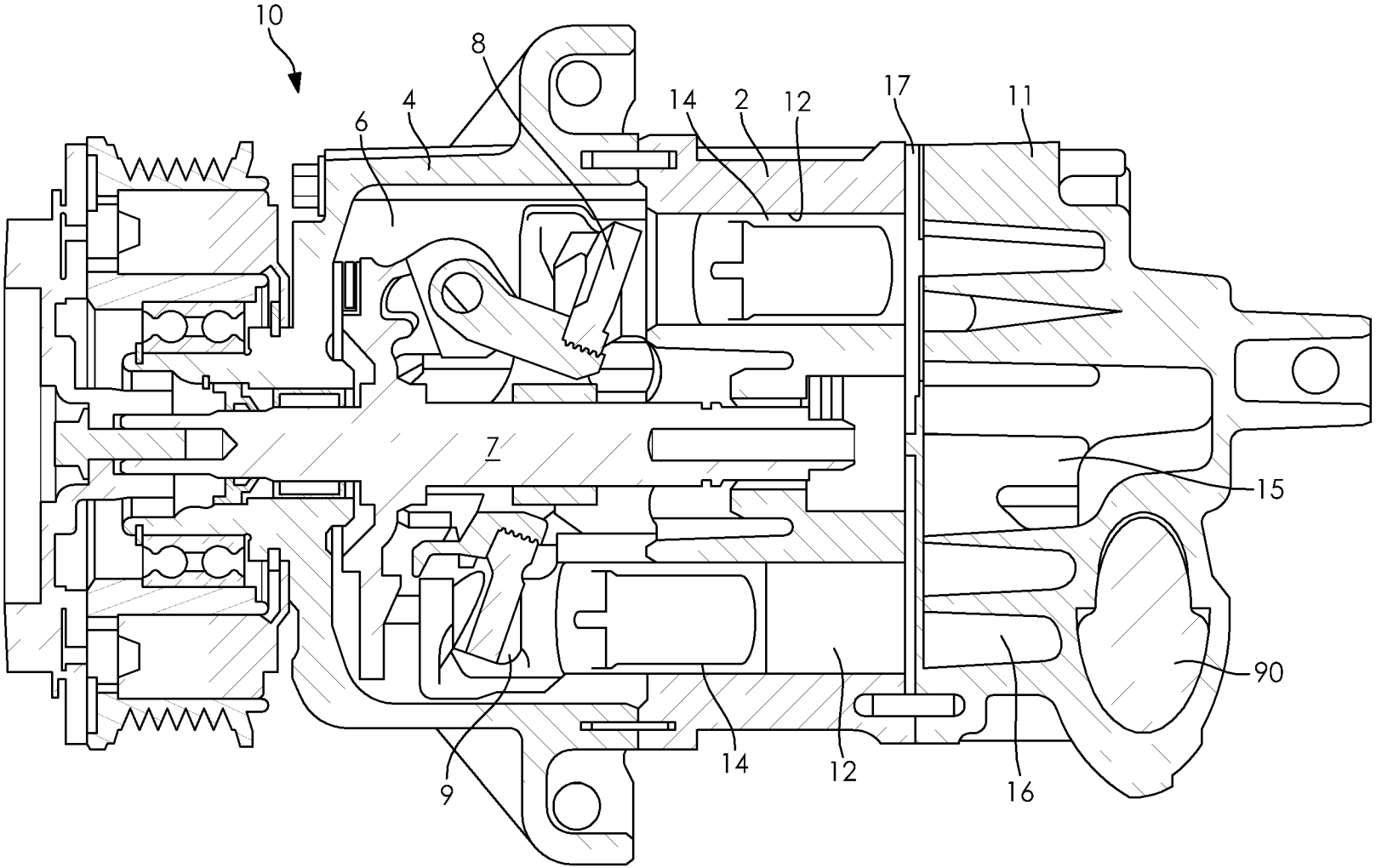
FIG. 1 is a cross-sectional elevational view of a variable displacement compressor according to an embodiment of the invention.

FIG. 1 illustrates a variable displacement compressor 10 according to an embodiment of the invention. The compressor 10 may be configured as a component of a heating, ventilating, and air conditioning (HVAC) system of a motor vehicle. The compressor 10 includes a cylinder block 2, a front housing 4, and a rear housing 11. The front housing 4 defines a crankcase chamber 6. The cylinder block 2 defines at least one cylinder bore 12 with a piston 14 reciprocatingly disposed in each of the cylinder bores 12. A valve plate 17 disposed intermediate the cylinder block 2 and the rear housing 11 defines a suction opening and a discharge opening or each of the respective cylinder bores 12.

The rear housing 11 defines a suction chamber 15 and a discharge chamber 16. The suction chamber 15 is fluidly coupled to a suction port 5 of the compressor 10 (shown in FIGS. 2-5 and 7). The suction port 5 forms an inlet for a refrigerant to flow into the compressor 10. The suction port 5 fluidly couples the compressor 10 to an upstream component of the HVAC system of the motor vehicle, such as an evaporator (not shown) or an expansion valve (not shown).

A drive shaft 7 is supported by the front housing 4 wherein a portion of the drive shaft 7 is disposed within the crankcase chamber 6. A swashplate 8 is mounted on the drive shaft 7 within the crankcase chamber 6 and is inclined at an angle with respect to a plane formed perpendicular to the rotational axis of the drive shaft 7. Each of the pistons 14 may be secured to the swashplate 8 by a shoe 9, which each of the shoes 9 allows for movement of the swashplate 8 relative to the pistons 14.

When the swashplate 8 is disposed at its minimum angle of inclination with respect to the plane formed perpendicular to the rotational axis of the drive shaft 7, each of the pistons 14 reciprocates to the least extent possible within each of the corresponding cylinder bores 12 as the drive shaft 7 rotates, thereby compressing a minimized volume of the refrigerant for each stroke of the corresponding piston 14. When the swashplate 8 is disposed at its greatest angle of inclination with respect to the plane formed perpendicular to the rotational axis of the drive shaft 7, the pistons 14 reciprocate in their respective cylinder bores 12 to the maximum extent, thereby compressing a maximized volume of the refrigerant for each stroke of the corresponding piston 14. As such, a flow rate of the refrigerant through the compressor 10 and hence a cooling capacity of the refrigerant exiting the compressor 10 is directly related to the angle of inclination of the swashplate 8 with respect to the plane formed perpendicular to the rotational axis of the drive shaft 7.

The angle of inclination of the swashplate 8 is selectively controlled by an electrically controlled control valve 90. The control valve 90 may generally comprise an electrical coil (not shown) for selectively positioning a valve element (not shown), wherein the valve element may be biased by one or more spring elements (not shown). The electrical coil may receive electrical power from a power source associated with the motor vehicle. The electrical coil is configured to apply an electromagnetic force to the valve element corresponding to the amount of current passing through the coil. The electromagnetic force applied to the valve element by the coil selectively positions the valve element relative to the surrounding structure of the control valve 90 and against the bias of any spring elements engaging the valve element. The amount of current passing through the coil may be determined by a control system of the motor vehicle associated with operating the compressor 10 according to the desired settings of a passenger of the motor vehicle.

The selective positioning of the valve element controls a pressure within the crankcase chamber 6 of the compressor 10, which in turn alters the angle of inclination of the swashplate 8 with respect to the plane formed perpendicular to the rotational axis of the drive shaft 7. The selective positioning of the valve element of the control valve 90 may, for example, selectively establish fluid communication between at least one of a discharge pressure of the refrigerant within the discharge chamber 16, a suction pressure of the refrigerant within the suction chamber 15, and a crankcase pressure of the refrigerant within the crankcase chamber 6. In some embodiments, additional portions of the compressor 10 having alternative pressures, such as a portion of the compressor including an oil filter or oil return passage for lubricating the compressor 10, may be in fluid communication with the crankcase chamber 6, as desired. The selective communication between the different chambers having the differing pressures may be accomplished via passageways (not shown) formed in the compressor 10 positioned to be selectively opened or closed based on the selective positioning of the valve element relative to the electrical coil and the associated passageways.

Figure 8:
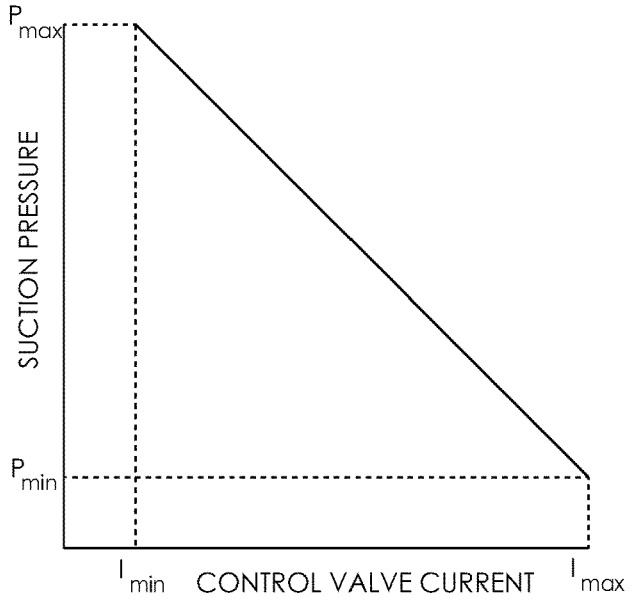
FIG. 8 is a chart showing an exemplary relationship between a suction pressure of the variable displacement compressor of FIG. 1 and a current used to energize a control valve of the variable displacement compressor.

The selective positioning of the valve element of the control valve 90 allows for the pressure within the crankcase chamber 6 to be controlled in a manner wherein the amount of current passing through the coil of the control valve 90 corresponds to a generally known angle of inclination of the swashplate 8 and therefore to a generally known cooling capacity of the compressor 10. For example, the control valve 90 may be adjustable between a plurality of positions controlling flow of the refrigerant between the suction chamber 15, the discharge chamber 16, and the crankcase chamber 6 to selectively change the crankcase pressure within the crankcase chamber 6. The swashplate 8 may be configured to be disposed at a minimum angle of inclination, which corresponds to a minimal cooling capacity of the compressor 10, when the crankcase pressure within the crankcase chamber 6 is maximized. The maximizing of the crankcase pressure within the crankcase chamber 6 may be accomplished by positioning the valve element of the control valve 90 at a position maximizing an amount of the refrigerant having the discharge pressure directed into the crankcase chamber 6. The maximizing of the flow of the refrigerant having the discharge pressure into the crankcase chamber 6 may correspond to the valve element of the control valve 90 being energized with a minimal amount of current, which is referred to as $I_{min}$ hereinafter. The compressor 10 operating at the minimized cooling capacity may therefore correspond to the control valve 90 being energized with the current $I_{min}$. The control valve 90 being energized with the current $I_{min}$ may also correspond to the suction pressure within the suction chamber 15 being maximized at a value $P_{max}$, as shown in FIG. 8, which shows a general relationship between the amount of current energizing the control valve 90 and the suction pressure present within the suction chamber 15.

In contrast, the swashplate 8 may be configured to be disposed at a maximum angle of inclination, which corresponds to a maximum cooling capacity of the compressor 10, when the crankcase pressure within the crankcase chamber 6 is minimized. The minimizing of the crankcase pressure within the crankcase chamber 6 may be accomplished by positioning the valve element of the control valve 90 at a position minimizing an amount of the refrigerant having the discharge pressure directed into the crankcase chamber 6. The minimizing of the flow of the refrigerant having the discharge pressure into the crankcase chamber 6 may correspond to the valve element of the control valve 90 being energized with a maximum amount of current, which is referred to as $I_{max}$ hereinafter. The compressor 10 operating at the maximized cooling capacity may therefore correspond to the control valve 90 being energized with the current $I_{max}$. The control valve 90 being energized with the current $I_{max}$ may also correspond to the suction pressure within the suction chamber 15 being minimized at a value of $P_{min}$, as shown in FIG. 8.

The swashplate 8 may be positioned at a plurality of intermediate angles of inclination when the current energizing the control valve 90 is intermediate $I_{min}$ and $I_{max}$. The increasing of the angle of inclination of the swashplate 8, and hence the increasing of the cooling capacity of the compressor 10, may be associated with an increasing of the current energizing the control valve 90 in order to reduce the amount of the discharge pressure communicated to the crankcase chamber 6. In contrast, the decreasing of the angle of inclination of the swashplate 8, and hence the decreasing of the cooling capacity of the compressor 10, may be associated with a decreasing of the current energizing the control valve 90 in order to increase the amount of the discharge pressure communicated to the crankcase chamber 6. The compressor 10 may accordingly be configured to have a substantially linear relationship between the angle of inclination of the swashplate 8, which corresponds to the cooling capacity of the compressor 10, and the amount of current energizing the control valve 90. However, there may alternatively be a non-linear relationship between the angle of inclination of the swashplate 8 and the current energizing the control valve 90 without departing from the scope of the present invention. The non-linear relationship may still utilize a relationship wherein an increase in the current energizing the control valve 90 corresponds to an increase in the angle of inclination of the swashplate 8 and wherein a decrease in the current energizing the control valve 90 corresponds to a decrease in the angle of inclination of the swashplate 8, as desired.

It is further understood that alternative or opposite relationships may be present between the current used to energize the control valve 90 and the angle of inclination of the swashplate 8 depending on the manner in which the control valve 90 regulates the communication between the various chambers of the compressor 10 having the differing pressures. For example, the control valve 90 may alternatively be configured wherein $I_{min}$ corresponds to a maximum cooling capacity of the compressor 10, and wherein an increase in the current energizing the control valve 90 causes the cooling capacity of compressor 10 to be continuously reduced until a minimized cooling capacity of the compressor 10 is achieved when the control valve 90 is energized with the current $I_{max}$. However, it is assumed hereinafter that the minimized cooling capacity corresponds to the control valve 90 being energized with the operating current $I_{min}$, the maximized cooling capacity corresponds to the control valve 90 being energized with the operating current $I_{max}$, and wherein intermediate cooling capacities correspond to operating currents intermediate $I_{min}$ and $I_{max}$.

Although the control valve 90 has generally been described as including a valve element that is moveable relative to an electrical coil and passageways associated with operation of the control valve 90, it is understood that any form of electrically controlled valve allowing for a selective adjustment of the angle of inclination of the swashplate 8 in response to the actuation of an electrically powered component may be used without departing from the scope of the present invention. Representative examples of electrically powered control valves suitable for controlling the angle of inclination of the swashplate 8 within the compressor 10 are disclosed in U.S. Pat. No. 6,390,782 to Booth et al., U.S. Pat. No. 7,014,428 to Pitla et al., U.S. Pat. No. 8,292,596 to Ota et al., and U.S. Patent Application Publication No. 2006/0083625 to Koyama et al., each of which is hereby incorporated by reference herein in its entirety.

Figure 2:
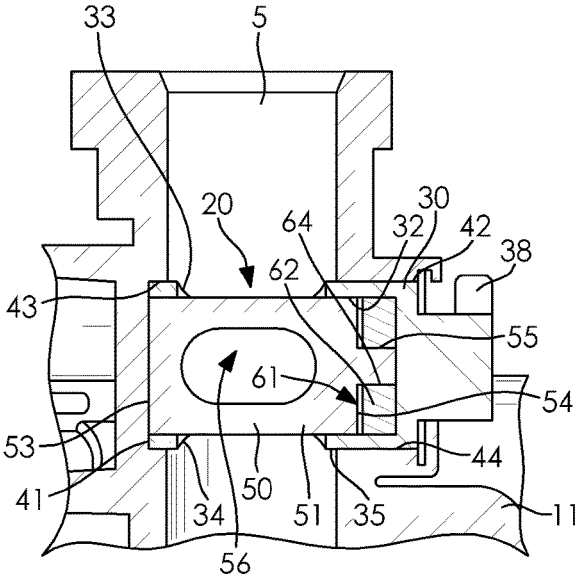
FIG. 2 is a fragmentary cross-sectional elevational view of a suction port of the variable displacement compressor of FIG. 1 having a suction damping device in a fully closed position according to an embodiment of the invention.
Figure 3:
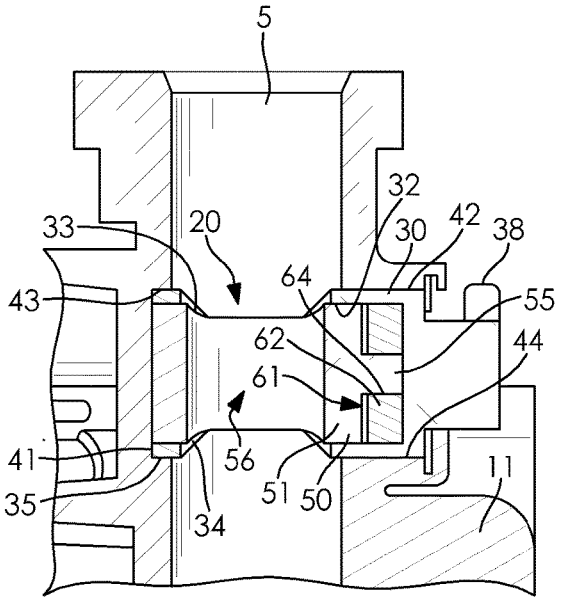
FIG. 3 is a fragmentary cross-sectional elevational view of the suction damping device of FIG. 2 while in a fully open position.
Figure 4:
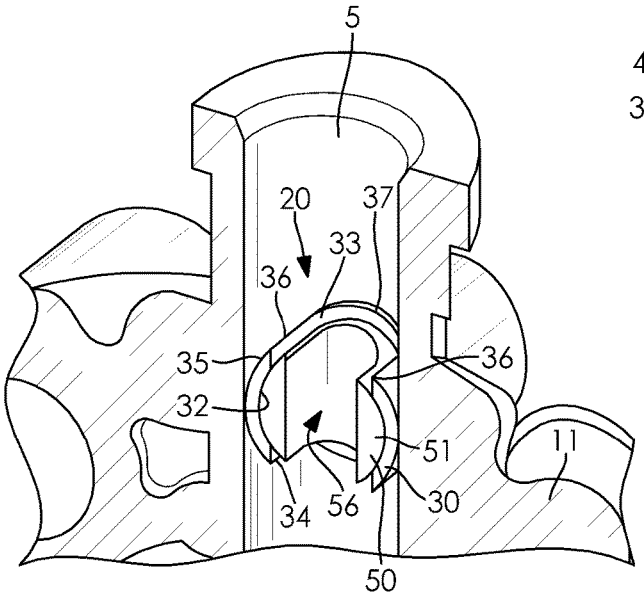
FIG. 4 is a fragmentary cross-sectional perspective view showing the suction damping device in the fully open position.
Figure 5:
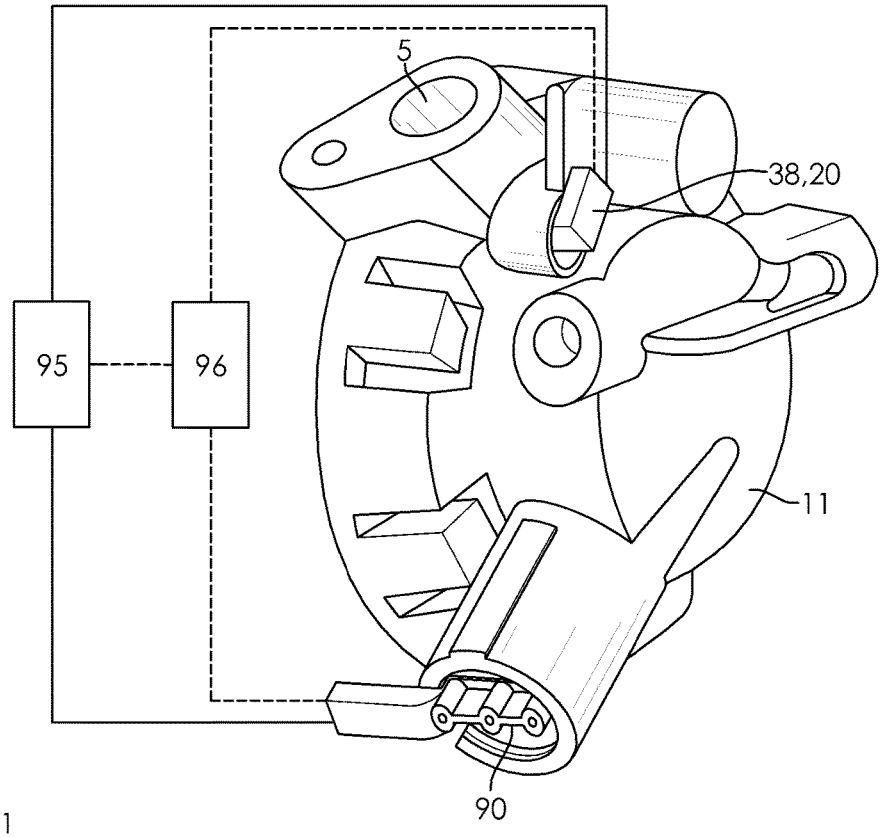
FIG. 5 is a partial schematic perspective view of a rear housing of the variable displacement compressor of FIG. 1 schematically showing a signal connection between the suction damping device and an electrically controlled valve of the variable displacement compressor.

Referring now to FIGS. 2-4, a suction damping device (SDD) 20 according to one embodiment of the invention is disposed within the suction port 5 of the rear housing 11. The SDD 20 is configured for controlling a flow of the refrigerant entering the compressor 10. The SDD 20 generally includes a stator 30 and a rotor 50 rotatable relative to the stator 30.

The stator 30 is cylindrical in shape and includes a longitudinal axis extending in a direction perpendicular to a direction of flow of the refrigerant through the suction port 5. The stator 30 includes a substantially cylindrical hollow interior 32 configured to receive the stator 30 therein. A first opening 33 and a second opening 34 formed in an outer surface 35 of the stator 30 provide fluid communication between the hollow interior 32 and the suction port 5. The first opening 33 may be formed in facing relationship with an upstream portion of the suction port 5 with respect to the flow direction of the refrigerant while the second opening 34 may be formed in a diametrically opposed portion of the outer surface 35 of the stator 30 in facing relationship with a downstream portion of the suction port 5.

As best shown with reference to FIG. 4, the first and second openings 33, 34 may each have a perimeter shape formed in the outer surface 35 of the stator 30 wherein each of the openings 33, 34 includes a pair of opposing linear edges 36 and a pair of opposing arcuate edges 37. The first and second openings 33, 34 may have alternative perimeter shapes such as a rectangular shape with sharp corners, a rounded rectangular shape, or an elliptical shape, as non-limiting examples. The first opening 33 and the second opening 34 may have the same shape and size or the first opening 33 and the second opening 34 may have a different shape and size, as desired. A cross-sectional flow area of each of the openings 33, 34 may be selected for conveying the refrigerant therethrough without negatively impacting a flow rate or a pressure drop of the refrigerant as it passes through the SDD 20 based on the desired operating mode of the compressor 10.

A first end 41 of the stator 30 is received in a first opening 43 formed in a portion of the rear housing 11 defining one side of the suction port 5 while a second end 42 of the stator 30 is received in a second opening 44 formed in a portion of the rear housing 11 defining the suction port 5 diametrically opposed to the first opening 43. The second opening 44 may extend from the suction port 5 through the rear housing 11 to an exterior surface of the compressor 10 to provide access for electrical components to the SDD 20.

The stator 30 is shown and described as a separate component to be received within a portion of the rear housing 11, but it should be understood that the stator 30 may instead be formed by portions of the rear housing 11 formed in accordance with the structure of the stator 30 as shown and described herein without departing from the scope of the present invention.

The rotor 50 is substantially cylindrical in shape and is rotatably received within the stator 30. The rotor 50 includes a main body 51 extending from a first end 53 disposed adjacent the first end 41 of the stator 30 to a second end 54 disposed adjacent the second end 42 of the stator 30. A shaft 55 having a reduced diameter in comparison to the main body 51 extends axially from the second end 54 of the main body 51. The shaft 55 defines an axis of rotation of the rotor 50 arranged substantially perpendicular to the direction of flow of the refrigerant through the suction port 5 when passing through the SDD 20. One or more bearings (not shown) or similar mechanisms for allowing one component to rotate relative to another may be used at an interface between the stator 30 and the rotor 50, as desired.

The main body 51 of the rotor 50 includes an aperture 56 formed therein extending from one side of the main body 51 to a diametrically opposed side thereof. The aperture 56 is shown as having a substantially elliptical or rounded rectangular cross-sectional shape, but alternative shapes may be utilized without departing from the scope of the present invention. The aperture 56 may be shaped and sized to substantially correspond in shape and size to the first and second openings 33, 34 formed in the stator 30, as desired.

The SDD 20 is actuated by an electromagnetic device 61 configured to control a rotational position of the rotor 50 relative to the stator 30. The electromagnetic device 61 may include a first electromagnetic component 62 and a second electromagnetic component 64. The first electromagnetic component 62 may be disposed within the hollow interior 32 of the stator 30 adjacent the second end 54 of the main body 51 of the rotor 50. The first electromagnetic component 62 may be annular in shape having a central opening for rotatably receiving the shaft 55 of the rotor 50. The second electromagnetic component 64 may be disposed within the shaft 55 of the rotor 50. The first electromagnetic component 62 may comprise a plurality of annularly arranged and circumferentially spaced electromagnets while the second electromagnetic component 64 may comprise a plurality of annularly arranged and circumferentially spaced permanent magnets within the shaft 55 of the rotor 50.

The first electromagnetic component 62 and the second electromagnetic component 64 may accordingly cooperate to form an electric stepper motor for precisely controlling a rotational position of the rotor 50 relative to the stator 30 by selective control of the electrical current passing through each of the electromagnets associated with the first electromagnetic component 62. It is understood that alternative electromagnetic devices 61 having alternative configurations suitable for precisely controlling the rotational position of the rotor 50 relative to the stator 30 may be utilized, as desired, without departing from the scope of the present invention. The electromagnetic device 61 may alternatively take the form of a brushless DC motor or a servo motor, as non-limiting examples of electrical actuating devices having precise rotational control.

An electrical connector 38 extends from the second end 42 of the stator 30. The electrical connector 38 provides electrical communication between the electromagnetic device 61 of the SDD 20 and a power source 95, as shown schematically in FIG. 5. The power source 95 may be any power source associated with the motor vehicle and may be the same power source associated with powering the electrically controlled control valve 90. The electrical connector 38 also provides signal communication between the electromagnetic device 61 and a controller 96. The controller 96 may be configured to exclusively operate the electrically controlled SDD 20 or the controller 96 may be associated with the operation of additional components of the motor vehicle, including operation of the control valve 90 and the power source 95. In the embodiment illustrated in FIG. 5, the power source 95 provides electrical power to each of the control valve 90 and the SDD 20 while the controller 96 is in signal communication with each of the control valve 90 and the SDD 20.

The rotor 50 is adjustable to a plurality of rotational positions relative to the stator 30 to alter the cross-sectional flow area for the refrigerant when passing through the SDD 20. FIG. 2 shows the rotor 50 when rotated to a fully closed position. The fully closed position of the rotor 50 includes the main body 51 at a rotational position wherein the aperture 56 is not in facing relationship with either of the first opening 33 or the second opening 34 formed in the stator 30 to prevent fluid communication between the first opening 33 and the second opening 34. Instead, the aperture 56 is in facing relationship with diametrically opposed portions of the stator 30 formed intermediate the first opening 33 and the second opening 34 while diametrically opposed portions of the main body 51 devoid of the aperture 56 are in facing relationship with the first opening 33 and the second opening 34. Such a configuration blocks the flow of the refrigerant through the suction port 5 and into the suction chamber 15 of the compressor 10. As such, it is understood that the illustrated fully closed position does not indicate a position of the rotor 50 relative to the stator 30 during operation of the compressor 10 requiring a flow of the refrigerant therethrough.

In contrast, FIGS. 3 and 4 show the rotor 50 when adjusted to a fully open position wherein the refrigerant is able to enter the compressor 10 at a maximized flow rate. The fully open position includes the rotor 50 rotated to a rotational position wherein the entirety of the aperture 56 is in alignment with each of the first opening 33 and the second opening 34 to produce the maximum cross-sectional flow area for the refrigerant passing through the SDD 20.

The rotor 50 is configured to be selectively positioned to a plurality of different rotational positions intermediate the fully closed and the fully open positions. As the rotor 50 is rotated away from the fully closed position illustrated in FIG. 2, a progressively increasing portion of the aperture 56 is caused to overlap a position of the first opening 33 of the stator 30, thereby progressively increasing a cross-sectional flow area through which the refrigerant may enter the aperture 56 through the first opening 33. Due to the symmetric arrangement of the openings 33, 34 relative to the rotational axis of the rotor 50, the second opening 34 is simultaneously caused to progressively overlap a position of an opposing end of the aperture 56, thereby progressively increasing the cross-sectional flow area through which the refrigerant may exit the aperture 56 while passing through the second opening 34. Additionally, the curved shape of each of the lateral ends of the aperture 56 causes the rate of change in the cross-sectional flow area per degree of rotation of the rotor 50 to vary as the aperture 56 is progressively brought into alignment with each of the first opening 33 and the second opening 34 of the stator 30 during rotation of the main body 51 of the rotor 50.

It is understood that the first opening 33 and the second opening 34 may include different shapes and sizes in a manner wherein the cross-sectional flow area present between the first opening 33 and the aperture 56 may differ from the cross-sectional flow area present between the second opening 34 and the aperture 56. Hereinafter, further reference to the cross-sectional flow area through the SDD 20 refers to the smaller of the cross-sectional flow area present between the aperture 56 and the first opening 33 and the cross-sectional flow area present between the aperture 56 and the second opening 34 as the smaller of the two cross-sectional flow areas ultimately controls the flow rate of the refrigerant through the SDD 20.

Figure 9:
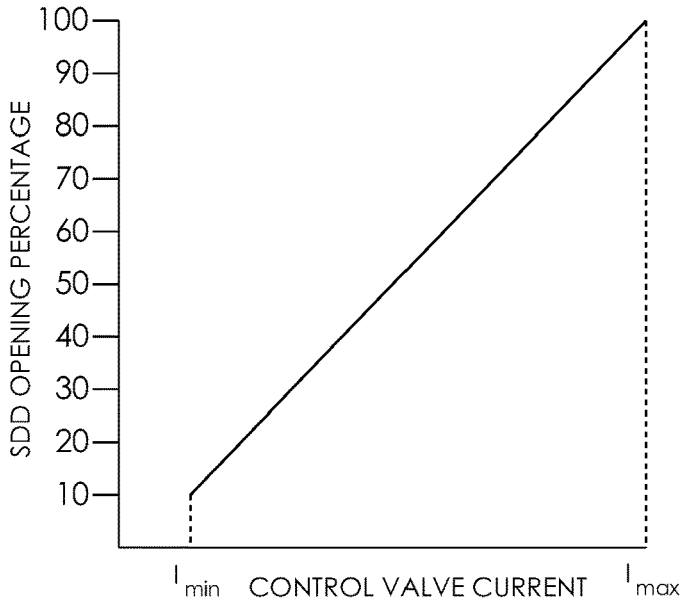
FIG. 9 is a chart showing an exemplary relationship between an opening percentage of the suction damping device of the variable displacement compressor of FIG. 1 and a current used to energize a control valve of the variable displacement compressor.

The rotational position of the rotor 50, and hence the cross-sectional flow area for the refrigerant to pass through the SDD 20, may directly correspond to the amount of current used to energize the control valve 90. For example, with reference to FIG. 9, when the control valve 90 is energized with the current $I_{min}$ corresponding to the minimized cooling capacity, the SDD 20 may be actuated to have a minimized cross-sectional flow area therethrough. The minimized cross-sectional flow area is shown in FIG. 9 as being about 10% of the cross-sectional flow area through the SDD 20 when the SDD 20 is in the fully open position, but other opening percentages may be used without departing from the scope of the present invention. In contrast, when the control valve 90 is energized to the current $I_{max}$ corresponding to the maximized cooling capacity, the SDD 20 is placed in the fully opened position corresponding to 100% of the possible cross-sectional flow area through the SDD 20 being opened for refrigerant flow therethrough. As shown in FIG. 9, there may be a substantially linear relationship between the current energizing the control valve 90 and the percentage of the maximum cross-sectional flow area through the SDD 20 at which the SDD 20 is opened. However, it is also understood that a non-linear relationship may be present between the current energizing the control valve 90 and the opening percentage of the SDD 20 without departing from the scope of the present invention. The non-linear relationship may still utilize a relationship wherein an increase in the current energizing the control valve 90 corresponds to an increase in the opening percentage of the SDD 20 and wherein a decrease in the current energizing the control valve 90 corresponds to a decrease in the opening percentage of the SDD 20, as desired.

Figure 10:
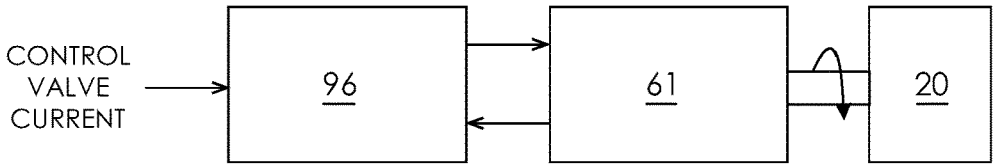
FIG. 10 is a schematic illustration of a control system for operating the suction damping device of FIG. 2.

FIG. 10 illustrates a schematic representation of a control system for regulating the cross-sectional flow area through the SDD 20. The controller 96 associated with the operation of the SDD 20 is in signal communication with the electromagnetic device 61. The controller 96 is configured to both send control signals to the electromagnetic device 61 and to receive control signals as feedback from the electromagnetic device 61. The electromagnetic device 61 is in turn configured to cause rotation of the rotor 50 of the SDD 20 as prescribed by the control signals received from the controller 96.

As shown in FIG. 10, the amount of current used to energize the control valve 90 is communicated to the controller 96. The amount of current may be communicated to the controller 96 via a control signal from another controller of the motor vehicle responsible for determining the amount of current necessary to operate the control valve 90 according to the desired cooling capacity of the compressor 10. In other embodiments, the amount of current may be sensed by a sensor associated with the controller 96 or may be communicated to the controller 96 by the control valve 90 or a controller otherwise associated with operation of the control valve 90. The controller 96 may alternatively be configured to control various different aspects of the motor vehicle and may be responsible for determining the amount of current energizing the control valve 90 based on an input provided by a passenger of the motor vehicle. It is understood that any method of communicating the amount of current energizing the control valve 90 to the controller 96 may be used without departing from the scope of the present invention.

Figure 11:
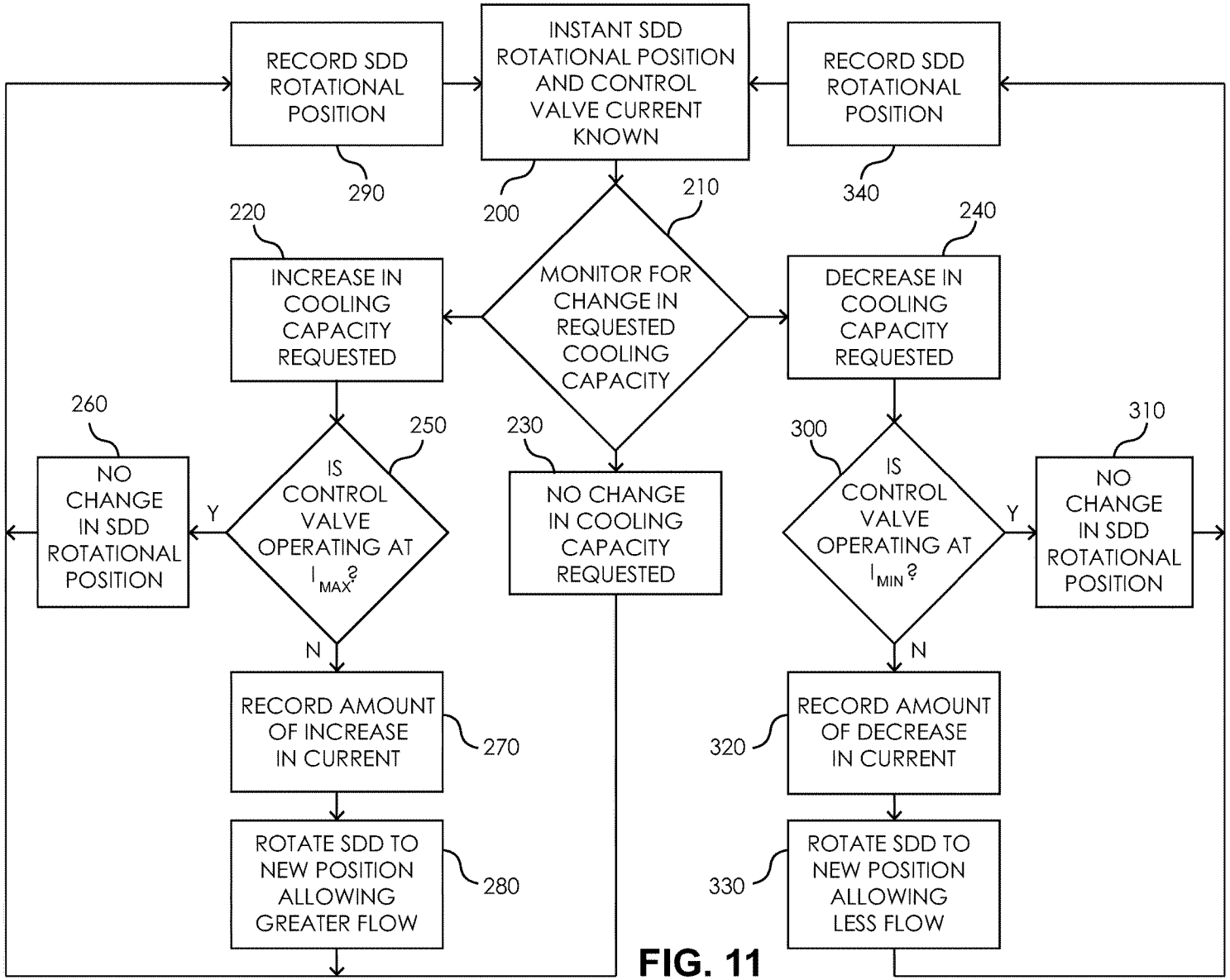
FIG. 11 is a flowchart illustrating exemplary control logic for operating the suction damping device of FIG. 2.

FIG. 11 illustrates one example of the control logic used to regulate the cross-sectional flow area through the SDD 20 based on the current energizing the control valve 90. The instantaneous rotational position of the rotor 50 of the SDD 20 and the instantaneous amount of current used to energize the control valve 90 are known by the controller 96 at a step 200. At a step 210, the controller 96 monitors the control system to determine if a passenger of the motor vehicle has requested a change in the cooling capacity of the compressor 10. The monitoring of the control system may include a determination that an increase in the cooling capacity of the compressor 10 has been requested (step 220), a determination that no change in the cooling capacity of the compressor 10 has been requested (step 230), or a determination that a decrease in the cooling capacity of the compressor has been requested (step 240).

If the controller 96 determines that an increase of cooling capacity has been requested as indicated at step 220, the controller 96 next determines at a step 250 whether the control valve 90 is already operating at $I_{max}$. If the control valve 90 is already operating at $I_{max}$, the controller 96 determines that the rotational position of the rotor 50 of the SDD 20 is not to be changed at a step 260. Alternatively, if the control valve 90 is operating at a current below $I_{max}$ when evaluated at step 250, the controller 96 determines and records the amount of the increase in the current requested for operating the control valve 90 in accordance with the desired cooling capacity at a step 270. Next, at a step 280, the controller 96 sends a control signal to the electromagnetic device 61 indicating that the rotor 50 of the SDD 20 is to be rotated to another rotational position indicating greater flow through the SDD 20. The new position of the rotor 50 of the SDD 20 is then recorded by the controller 96 at a step 290. As shown in FIG. 11, the determination at step 230 that no change in cooling capacity has been requested or the determination at step 250 that the control valve 90 is already operating at $I_{max}$ will each lead to the controller 96 recording the rotational position of the rotor 50 of the SDD 20 as unchanged.

Alternatively, if the controller 96 determines that a decrease in cooling capacity has been requested as indicated at step 240, the controller 96 next determines at a step 300 whether the control valve 90 is already operating at $I_{min}$. If the control valve 90 is already operating at $I_{min}$, the controller 96 determines that the rotational position of the rotor 50 of the SDD 20 is not to be changed at a step 310 and the instantaneous rotational position of the SDD 20 is recorded at a step 340. Alternatively, if the control valve 90 is operating at a current above $I_{min}$, the controller 96 determines and records the amount of the decrease in the current requested for operating the control valve 90 in accordance with the desired cooling capacity at a step 320. Next, at a step 330, the controller 96 sends a control signal to the electromagnetic device 61 indicating that the rotor 50 of the SDD 20 is to be rotated to another rotational position indicating less flow through the SDD 20. The new position of the rotor 50 of the SDD 20 is then recorded by the controller 96 at a step 340.

The repositioning of the rotor 50 of the SDD 20 at either of steps 280 or 330 may be based on the relationship present between the current energizing the control valve 90 and the opening percentage of the SDD 20 as illustrated in FIG. 9, wherein the opening percentage of the SDD 20 is related to the rotational position of the rotor 50 of the SDD 20, the shape of the openings 33, 34 formed in the stator 30, and the shape of the aperture 56 formed in the rotor 50. As should be understood, the shape of either of the openings 33, 34 or the aperture 56 may result in a varying change in the cross-sectional flow area through the SDD 20 due to a varying rate of overlap present between aperture 56 and the openings 33, 34 during rotation of the rotor 50 relative to the stator 30. For example, the rate in change in the cross-sectional flow area through the SDD 20 will vary between those portions of the aperture 56 having a curved perimeter shape in comparison to those portions of the aperture 56 having a rectilinear perimeter shape. The varying of the rate of change in the overlap present between the openings 33, 34 and the aperture 56 may be utilized to control for various operating conditions of the SDD 20 or the compressor 10 more generally, such as reducing an incidence of suction pressure pulsations when the refrigerant passes through the SDD 20 at certain rotational positions of the rotor 50 relative to the stator 30.

The controller 96 may include a look-up table stored to a memory thereof including an appropriate rotational positioning of the rotor 50 of the SDD 20 based on the determination of the amount of current being delivered to the control valve 90 when a passenger of the motor vehicle selects a desired cooling capacity. The look-up table may include data indicating a desired rotational position of the rotor 50 for a given current delivered to the control valve 90 in order to achieve a desired flow rate of the refrigerant through the SDD 20. The look-up table may for example include information regarding the desired rotational position of the rotor 50 for achieving a desired opening percentage of the SDD 20 for each value of the current energizing the control valve 90 between and including $I_{min}$ and $I_{max}$. For example, the look-up table may include data corresponding to the relationship presented in FIG. 9 between the current delivered to the control valve 90 and the opening percentage of the SDD 20. As one non-limiting example, the selection of a cooling capacity of the compressor 10 indicating that the current delivered to control valve 90 is one half of the difference between $I_{min}$ and $I_{max}$ may result in the rotor 50 being positioned to result in an opening percentage of about 55% through the SDD 20. The look-up table may alternatively utilize data regarding the preferred rotational position of the rotor 50 relative to the stator 30 that is determined experimentally. The experimental determination of the data may include adjusting the rotational position of the rotor 50 relative to the stator 30 for each increment of the current delivered to the control valve 90 to determine which rotational position best corresponds to the desired operating conditions of the compressor 10 for each tested increment of the current.

The controller 96 may alternatively be programmed to utilize the value of the current delivered to the control valve 90 and communicated to the controller 96 as an input value for an equation for determining a suitable rotational position of the rotor 50 based on the desired opening percentage of the SDD 20, wherein the equation may utilize a linear relationship between the current energizing the control valve 90 and the opening percentage of the SDD 20 as presented in FIG. 9. The equation may alternatively result in a non-linear relationship present between the current energizing the control valve 90 and the opening percentage of the SDD 20 as discussed briefly hereinabove, as desired.

In use, the passenger of the motor vehicle selects an operational mode for the HVAC system requiring compression of the refrigerant passing through the compressor 10. Based on the user selected operational mode, the control valve 90 is energized by a power source to a desired position for controlling the crankcase pressure within the crankcase chamber 6, which in turn places the swashplate 8 at a desired angle of inclination corresponding to the user selected operational mode. The controller 96 receives information regarding the current being delivered to the control valve 90 and makes a determination of whether the rotor 50 of the SDD 20 is in need of repositioning as set forth in FIG. 11. If the controller 96 determines that a repositioning of the rotor 50 is desired, the controller 96 sends a control signal to the electromagnetic device 61 indicating that the rotor 50 is to be rotated to a desired rotational position based on the information stored to the controller 96, such as the look-up table or the equation setting forth the relationship between the opening percentage of the SDD 20 and the current delivered to the control valve 90.

For example, the passenger of the motor vehicle may select an operational mode wherein the compressor 10 operates with the minimized length of the stroke of each of the pistons 14 within each of the corresponding cylinder bores 12 caused by the swashplate 8 having a minimized angle of inclination with respect to the plane formed perpendicular to the rotational axis of the drive shaft 7. The selection of the operational mode having the minimized stroke length results in the power source 95 energizing the coil of the control valve 90 with the current $I_{min}$ for achieving a desired crankcase pressure within the crankcase chamber 6. The controller 96 utilizes the look-up table or the equation stored to the memory thereof to determine the desired rotational position of the rotor 50 relative to the stator 30 for achieving the desired flow rate of the refrigerant through the SDD 20. The controller 96 may determine, for example, that the current $I_{min}$ being passed through the electrical coil of the control valve 90 corresponds to rotating the rotor 50 relative to the stator 30 to a first rotational position having a minimized cross-sectional flow area through the SDD 20. The first rotational position may include about 10% of the cross-sectional flow area of each end of the aperture 56 exposed to each of the first opening 33 and the second opening 34 while rotating the rotor 50 to a rotational position about 10 degrees away from the fully closed position, as one non-limiting example. The controller 96 sends the control signal to the electromagnetic device 61, which accordingly repositions the rotor 50 relative to the stator 30 in accordance with the data provided by the look-up table or the equation stored to the memory of the controller 96.

As an alternative example, the passenger of the motor vehicle may desire an operational mode wherein the pistons 14 are caused to reciprocate with a maximized stroke length within each of the corresponding cylinder bores 12 caused by the swashplate 8 having a maximized angle of inclination with respect to the plane formed perpendicular to the rotational axis of the drive shaft 7. The selection of the operational mode having the maximized stroke length results in the power source 95 energizing the coil of the control valve 90 with the current $I_{max}$ for achieving a desired crankcase pressure within the crankcase chamber 6. The controller 96 utilizes the look-up table stored to the memory thereof to determine the desired rotational position of the rotor 50 relative to the stator 30 for achieving the desired flow rate of the refrigerant through the SDD 20. The controller 96 may determine, for example, that the current $I_{max}$ corresponds to rotating the rotor 50 to a second rotational position. The second rotational position may include about 100% of the cross-sectional flow area of the aperture 56 exposed to each of the first opening 33 and the second opening 34 while rotating the rotor 50 to the fully open position. The controller 96 sends the control signal to the electromagnetic device 61, which repositions the rotor 50 relative to the stator 30 in accordance with the data provided by the look-up table or the equation stored to the memory of the controller 96.

The look-up table or the equation of the controller 96 may be used to determine a plurality of different rotational positions of the rotor 50 intermediate the two positions discussed hereinabove to achieve a plurality of different cross-sectional flow rates through the SDD 20 depending on the desired length of stroke of each of the pistons 14 within a corresponding cylinder bore 12.

The controller 96 may also be utilized to ensure that the SDD 20 is always at a preferred position during operation of the compressor 10. For example, the controller 96 may be configured to always return the rotor 50 to a specified position, such as the fully open position or the fully closed position, following each period of use of the compressor 10 and the SDD 20. The rotational position of the rotor 50 is accordingly known when the compressor 10 and SDD 20 are first activated, thereby allowing for the rotor 50 to be rotated through a known angular displacement before arriving at the desired rotational position. Alternatively, the controller 96 may be configured to store data regarding the rotational position of the rotor 50 following each rotation thereof, thereby allowing for any subsequent rotations to be considered relative to the prior recorded rotational position. As a result, the SDD 20 is capable of precise and repeatable control of the rotational motion of the rotor 50 relative to the stator 30.

It should be understood by one skilled in the art that the variable cross-sectional flow area of the refrigerant through the SDD 20 based on the rotational position of the rotor 50 relative to the stator 30 may be achieved by various modifications of the structure of either of the rotor 50 or the stator 30. For example, the aperture 56 of the rotor 50 may alternatively include a perimeter including substantially rectilinear edges while the first opening 33 and the second opening 34 of the stator 30 may include perimeters including curvilinear edges suitable for causing a variable overlap between the aperture 56 and either of the first opening 33 and the second opening 34 during selective rotation of the rotor 50 relative to the stator 30.

It should further be understood that the general concept of utilizing rotational motion of a rotor relative to a stator to determine the cross-sectional flow area through the SDD based on the current passing through an electrically controlled control valve may alternatively be adapted for utilizing translational motion to determine the cross-sectional flow area through the SDD. For example, the rotational motion of a rotor may be transferred to the translational motion of a sliding component selectively extended across the suction port of the compressor using any known mechanism for transferring the rotational motion from one component to translational motion of another component. As the rotational position of the rotor is controlled, so to is the extent by which the sliding component extends across the suction port of the compressor for blocking the flow of the refrigerant therethrough, thereby creating a variable cross-sectional flow area through the SDD based on the rotational position of the rotor.

The desired rotational position of the rotor 50 relative to the stator 30 has been described exclusively as a function of the current caused to pass through an electrically energized component of the control valve 90, but it should be further understood that other characteristics of the compressor 10 capable of being monitored by the controller 96 and associated with the data stored to the look-up table may be utilized in the determination of the desired rotational position of the rotor 50 relative to the stator 30 without departing from the scope of the present invention. For example, the rotational position of the rotor 50 relative to the stator 30 may be a function of one or more of the suction pressure within the suction chamber 15, the discharge pressure within the discharge chamber 16, and the crankcase pressure within the crankcase chamber 6, wherein each of the associated pressure values is monitored by sensors in signal communication with the controller 96 for determining an angle of inclination of the swashplate 8. Alternatively, the controller 96 may be in signal communication with a sensor configured to directly measure the angle of inclination of the swashplate 8. Various other characteristics of the compressor 10 relating to the desired flow rate of the refrigerant entering the suction port 5 may be used to determine the desired rotational position of the rotor 50 relative to the stator 30 for each selected operational mode of the compressor 10 without departing from the scope of the present invention so long as the resulting positioning of the rotor 50 is based on a control signal indicating a condition of a portion of the compressor 10 or any components associated with the operation of the compressor 10.

The SDD 20 provides several advantages over the suction damping devices of the prior art. First, the cross-sectional flow area through the SDD 20 is controlled based on a condition of the control valve 90 known by or monitored by the controller 96, resulting in a desired configuration of the SDD 20 being communicated to the SDD 20 without requiring additional flow passageways or mechanisms within the compressor 10 for communicating various different pressures to the SDD to determine a configuration of the SDD. Second, the SDD 20 is capable of repeatable and very precise control of the flow area through the SDD by use of the electrically controlled electromagnetic device 61. Third, the manner in which the rotor 50 rotates about an axis perpendicular to the flow direction of the refrigerant allows for a maximum flow area through the SDD 20 to be achieved as the openings 33, 34 and the aperture 56 can be dimensioned to extend across an entirety of the suction port 5, as desired. Fourth, the rotational position of the rotor 50 relative to the stator 30 is capable of being fixed during use of the compressor 10, in contrast to an SDD having a plunger that is selectively repositioned based on an instantaneous pressure experienced within a portion of the compressor 10.

Figure 6:
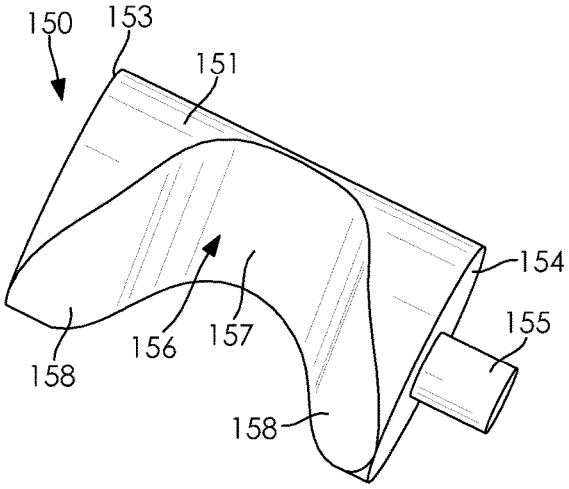
FIG. 6 is a perspective view of a rotor of a suction damping device according to another embodiment of the invention.
Figure 7:
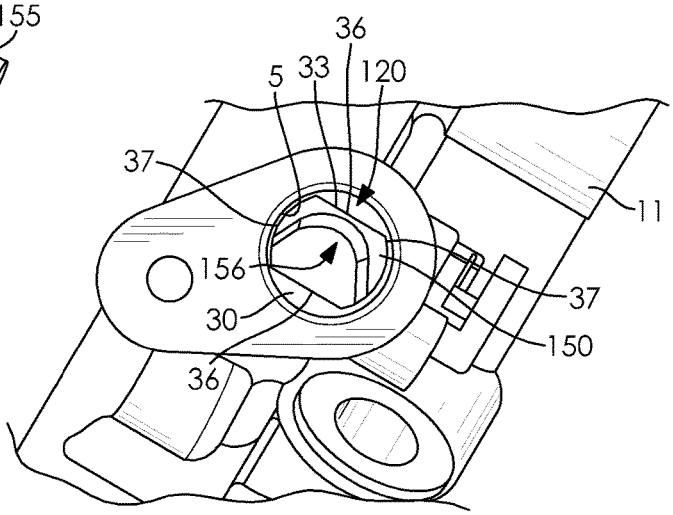
FIG. 7 is a fragmentary perspective view of the rotor of FIG. 6 when installed into the suction port of the variable displacement compressor of FIG. 1.

FIGS. 6 and 7 illustrate a rotor 150 according to another embodiment of the invention. The rotor 150 may be used with the stator 30 illustrated in FIGS. 2-4 in place of the rotor 50. The rotor 150 is substantially cylindrical in shape and includes a main body 151 extending from a first end 153 to a second end 154. A shaft 155 having a reduced diameter in comparison to the main body 151 extends axially from the second end 154 of the main body 151. The shaft 155 defines an axis of rotation of the rotor 150 arranged substantially perpendicular to the direction of flow of the refrigerant through the suction port 5 when passing through the SDD 20.

The main body 151 of the rotor 50 includes an aperture in the form of an indentation 156 formed therein extending from one side of the main body 151 in a direction towards a diametrically opposed side of the main body 151. The indentation 156 may include a depth in a direction extending perpendicular to the rotational axis of the rotor 150 penetrating from the one side surface beyond the rotational axis of the rotor 150, as desired.

The indentation 156 may have a profile having a curvilinear shape wherein a rate of change of the cross-sectional flow area through the SDD 20 as the rotor 150 is rotated relative to the stator 30 is varied at different rotational positions of the rotor 150. For example, the indentation 156 is shown in FIG. 6 as including a centrally located concave surface 157 and a pair of laterally located convex surfaces 158, resulting in a variable slope of the profile of the indentation 156 with respect to one of the straight edges forming the perimeter of either of the first opening 33 or the second opening 34 of the stator 30. The change in slope of the profile of the indentation 156 allows for the change in cross-sectional flow area of the refrigerant through the SDD 20 to be precisely controlled when repositioning the rotor 150 from one rotational position to another rotational position.

The curvilinear shape of the profile of the indentation 156 may be selected to minimize or alter the acoustic pressure levels of the refrigerant when passing through the SDD 20. The curvilinear shape of the profile of the indentation 156 may be further selected to "tune" the SDD 20 for different acoustic pressure frequencies to control the frequency of vibrations experienced by the SDD 20, as desired. For example, it may be beneficial to tune the SDD 20 for a specific acoustic pressure frequency to avoid producing an acoustic pressure frequency similar to a resonant frequency of any portion of the HVAC system of the motor vehicle, and especially the evaporator of the HVAC system where suction pulsations are readily audible in the passenger compartment of the motor vehicle. The shape of the profile of the indentation 156 may accordingly be selected to both lower the amplitude of the acoustic pressure vibrations as well as to change the frequency at which the acoustic pressure vibrations occur.

An SDD 120 utilizing the rotor 150 operates in similar fashion to the SDD 20 having the rotor 50. The rotor 150 is rotated by the electromagnetic device 61 to a plurality of different rotational positions relative to the stator 30 to cause an overlap formed between the indentation 156 of the rotor 150 and each of the first opening 33 and the second opening 34 of the stator 30 to vary, thereby creating varying cross-sectional flow areas through the SDD 120 for passing the refrigerant. The rotational position of the rotor 150 relative to the stator 30 is similarly controlled by the controller 96 with reference to the look-up table stored to the memory of the controller 96.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A suction damping device for a variable displacement compressor, the suction dampening device comprising:

a rotor having a rotational axis, an aperture extending through the rotor in a direction transverse to the rotational axis, a selective rotation about the rotational axis of the rotor controlling a flow of a fluid through the aperture of the rotor, and a stator having an interior configured to rotatably receive the rotor therein, wherein at least one opening formed in the stator facing the rotor in the direction transverse to the rotational axis provides fluid access to the interior of the stator, wherein the aperture of the rotor is an indentation formed in an outer surface of the rotor extending radially inwardly towards the rotational axis, wherein the indentation has a profile having a curvilinear shape extending from a first end to a second end of the rotor in the direction of the rotational axis, and wherein the indentation includes a centrally located concave surface and a pair of laterally located convex surfaces.

2. The suction damping device of claim 1, wherein the selective rotation of the rotor about the rotational axis varies an overlap present between the aperture of the rotor and the at least one opening of the stator.

3. The suction damping device of claim 1, further comprising an electromagnetic device selectively rotating the rotor about the rotational axis.

4. The suction damping device of claim 1, wherein the aperture of the rotor is an opening extending from a first side of the rotor to a second side of the rotor.

5. The suction damping device of claim 1, wherein the pair of convex surfaces extend from both sides of the concave surface to the first end and the second end of the rotor, respectively.

6. A variable displacement compressor comprising:

an electrically controlled valve configured to selectively control an angle of inclination of a swashplate of the variable displacement compressor; and a suction damping device including a rotor having a rotational axis, an aperture extending through the rotor in a direction transverse to the rotational axis, the rotor selectively rotated about the rotational axis based on a condition of the electrically controlled valve to control a flow of a fluid through the aperture of the rotor;

wherein the aperture of the rotor is an indentation formed in an outer surface of the rotor extending radially inwardly towards the rotational axis.

7. The variable displacement compressor of claim 6, wherein the indentation has a profile having a curvilinear shape extending from a first end to a second end of the rotor.

8. The variable displacement compressor of claim 7, wherein the indentation includes a centrally located concave surface and a pair of laterally located convex surfaces.

9. The variable displacement compressor of claim 8, wherein the pair of convex surfaces extend from both sides of the concave surface to the first end and the second end of the rotor, respectively.

* * * * *